US011596846B2

(12) United States Patent
León, III

(10) Patent No.: US 11,596,846 B2
(45) Date of Patent: Mar. 7, 2023

(54) INTERACTIVE HEAVY BAG TRAINING APPARATUS WITH DYNAMIC POSITIONING AND ADAPTIVE CONTROL

(71) Applicant: Mario Oviedo León, III, Spring Valley, CA (US)

(72) Inventor: Mario Oviedo León, III, Spring Valley, CA (US)

( * ) Notice: Subject to any disclaimer, the term of this patent is extended or adjusted under 35 U.S.C. 154(b) by 92 days.

(21) Appl. No.: 16/923,642

(22) Filed: Jul. 8, 2020

(65) Prior Publication Data

US 2021/0008428 A1 Jan. 14, 2021

Related U.S. Application Data

(60) Provisional application No. 62/872,586, filed on Jul. 10, 2019.

(51) Int. Cl.
*A63B 69/32* (2006.01)
*A63B 69/20* (2006.01)

(52) U.S. Cl.
CPC ..... *A63B 69/32* (2013.01); *A63B 69/305* (2022.08); *A63B 2220/53* (2013.01); *A63B 2225/20* (2013.01); *A63B 2244/102* (2013.01)

(58) Field of Classification Search
CPC ... A63B 69/32; A63B 69/201; A63B 2220/53; A63B 2225/20; A63B 2244/102; A63B 69/305; A63B 24/0062; A63B 69/0053; A63B 71/023; A63B 71/0622; A63B 2024/0068; A63B 2071/0625; A63B 2071/0675; A63B 2214/00; A63B 2220/17; A63B 2220/40; A63B 2220/62;
(Continued)

(56) References Cited

U.S. PATENT DOCUMENTS 5,503,606 A * 4/1996 Stephens ..... A63B 69/34 482/7
7,488,276 B2 2/2009 Luigi
(Continued)

FOREIGN PATENT DOCUMENTS

CN 106390412 A * 2/2017
CN 106390412 A * 2/2017 ..... A63B 69/20
(Continued)

*Primary Examiner* — Sundhara M Ganesan
(74) *Attorney, Agent, or Firm* — Continuum Law; Robert P. Cogan

(57) ABSTRACT

An apparatus, method, and a non-transitory programmed medium provide a structure to move a heavy bag to simulate sparring along with a method and programmed media to provide selective training experiences. Drive motors in a Cartesian gantry provide multi-axis lateral motion in a horizontal plane. The heavy bag is instrumented to generate information indicative of performance of the user. Also, the heavy bag receives information to prompt a user with indicators such as LEDs. A moving target simulates a boxing match. A user responds to motions of a heavy bag in an X-Y plane whether toward or away from the user. It may be used as a sparring partner. Electronic controls provide a pre-selected pattern of movement. Training programs include sequences designed by professional boxers and trainers. Controls may be adaptive to vary responses of the apparatus in response to user performance.

15 Claims, 15 Drawing Sheets

(58) Field of Classification Search
CPC ..... A63B 2220/803; A63B 2220/833; A63B 2225/50; A63B 2225/76
See application file for complete search history.

(56) References Cited

U.S. PATENT DOCUMENTS

| | | | | |
|---|---|---|---|---|
| 8,777,819 | B1 * | 7/2014 | Quintana | A63B 69/201 482/83 |
| 9,056,235 | B1 | 6/2015 | Mortland | |
| 9,227,128 | B1 * | 1/2016 | Carfagna, Jr. | A63B 24/0087 |
| 9,586,120 | B1 | 3/2017 | Sotelo | |
| 9,782,652 | B2 | 10/2017 | Williamson | |
| 9,821,208 | B2 | 11/2017 | Hall | |
| 10,065,098 | B2 | 9/2018 | Almeras | |
| 10,213,672 | B2 | 2/2019 | Codrington | |
| 2004/0224826 | A1 * | 11/2004 | O'Shea | A63B 69/34 482/83 |
| 2004/0248633 | A1 * | 12/2004 | Trawick | A63B 69/34 463/8 |
| 2010/0130329 | A1 * | 5/2010 | Sullivan | A63B 69/0053 482/4 |
| 2012/0279311 | A1 * | 11/2012 | Helmer | F41J 5/041 73/768 |
| 2014/0366645 | A1 * | 12/2014 | Tsai | G01L 5/0052 73/862.041 |
| 2014/0378281 | A1 | 12/2014 | Mazi | |
| 2016/0059102 | A1 | 3/2016 | Williamson | |
| 2017/0036087 | A1 | 2/2017 | Codrington | |
| 2018/0065016 | A1 * | 3/2018 | Hall | A63B 69/206 |

FOREIGN PATENT DOCUMENTS

| | | | | |
|---|---|---|---|---|
| GB | WO 2007012830 | A2 * | 1/2007 | |
| RU | 2201784 | C2 * | 4/2003 | |
| RU | 2201784 | C2 * | 4/2003 | A63B 69/00 |
| WO | WO-2007012830 | A2 * | 2/2007 | A63B 24/0003 |

* cited by examiner

INTERACTIVE HEAVY BAG TRAINING APPARATUS WITH DYNAMIC POSITIONING AND ADAPTIVE CONTROL

CROSS REFERENCE TO RELATED APPLICATION

This patent application claims priority to U.S. Provisional Patent Application Ser. No. 62/872,586 filed Jul. 10, 2019, which is incorporated herein by reference in its entirety.

FIELD

The present subject matter relates to apparatus for physical training and more specifically to a hanging heavy punching bag training apparatus for boxing and martial arts which provides an automated moving target to simulate a sparring partner or opponent.

BACKGROUND

Heavy bag training is used for physical training in a wide variety of contexts. Heavy bag training is an essential activity for boxers and mixed martial arts fighters. The heavy bag is a widely used piece of equipment by people of all ages. Heavy bags are used in training gyms and fitness centers as well. The heavy bag is used by nonfighters for physical conditioning and development in their workout regime. Heavy bag training is used for developing power, strength, and stamina. Heavy bag workouts are a significant part of a fighter's training.

"Heavy bag" is a term of art in the field of athletic equipment. A nominal heavy bag is a cylindrical stuffed bag made of leather or vinyl usually weighing between 40 pounds and 100 pounds. The heavy bag is usually suspended by chains or ropes when supported from the top. In another form the heavy bag rests on a floor support and in some forms pivoting about a point on the floor support. The prior art designs have supported heavy bags essentially to a single point in an X-Y plane. Current state of the art machines include an apparatus having a boom arm supporting a heavy bag and rotating around a vertical axis. Previous heavy bags are essentially stationary as they cannot respond to a user's punches, kicks, or the like and they cannot move around to allow for simulating contact with an opponent.

One exemplary bag is the Everlast Leather Heavy Bag SKU 247001. One model weighs 100 lbs., has a diameter of 14.5", and is 52" in height. Another heavy bag is Ringside Boxing Large Leather Heavy Bag SKU LLHB 130 S. This heavy bag weighs 130 lbs., has a diameter of 16", and is 48" in height.

The conventional heavy bag training apparatus comprises a stationary support from which a heavy bag hangs. The support provides for a stationary target. Since the hanging bag is stationary a user does not get to practice attacking a moving target while training to build up power. Increasing skill in attacking a moving target would be a significant additional benefit. Prior art heavy bag training apparatus has a very limited capability of simulating engagement by a fighter with an opponent.

BotBoxer, produced by SkyTechSport, Inc. of Los Angeles, Calif., is promoted as, "The Only Robot for Martial Arts.". A heavy bag is supported to a vertical support. A lower end of the vertical support pivots on a base. The base is supported in a fixed position to a floor. There is no movement of the base in an X-Y plane. Though called a "robot" it does not provide a user with the experience of an opponent moving back and forth or laterally.

U.S. Pat. No. 10,213,672 discloses a heavy bag having a display at the surface and a microprocessor in the interior of the heavy bag. The microprocessor provides information to the display indicative of impact of blows delivered by a user. The support for the heavy bag does not move. The position of an element supporting the bag cannot move.

United States Patent Application Publication No. 2014/0378281 discloses an apparatus which is called a robotic sparring partner. The apparatus comprises a torso operatively engaged with arms, legs, and a head. The torso is supported on a stationary stand. The human user wears a plurality of tags, such as RFID tags or reflective strips. Offensive and counter movements provided by the torso have only limited utility because the torso must stay in one place.

U.S. Pat. No. 10,065,098 discloses a training appliance which includes a punching bag having an envelope comprising a preferably cylindrical vertical wall and a bottom wall which may comprise a hemisphere. The bottom wall is received in a substantially spherical bowl in a base. The base allows pivoting movement of the bag around a point of contact in the base. Some pivoting motion is allowed. However, a base of the bag remains in position on a stationary mount. This does not allow for moving the position of a vertically suspended heavy bag.

U.S. Pat. No. 9,821,208 discloses a multi-headed, multi-abdomen, multi-armed apparatus. The multi-headed, multi-abdomen, multi-armed apparatus provides various angles adapted for a user to punch, knee, and/or do a flying knee. However, lateral motion in an X-Y plane is not provided.

U.S. Pat. No. 7,488,276 discloses a workout machine wherein a boxing training device comprises a generally cylindrical device having a pair of padded arms each having a boxing glove at its end. The arms rotate in response to an user's blows. One form of motion is provided. The bag is suspended from a fixed position in a horizontal plane. The apparatus rotates, but it does not move laterally and does not provide the ability for the device to advance on the user.

U.S. Pat. No. 9,782,652 provides instrumentation in a heavy bag to monitor limited aspects of a user's workout. A plurality of transducers respond to intensity of a blow to the heavy bag. Relative intensity of impact at different sensors is used to estimate location of the blow. The system provides a limited amount of information and does not provide information directly to the user. A moving target is not provided.

U.S. Pat. No. 9,056,235 discloses a gantry assembly supporting a plurality of heavy bags suspended side by side. A user may strike at bags in different positions, but the individual bags do not change position.

U.S. Pat. No. 9,586,120 discloses an automated heavy punching bag that has robotic arms which can rotate to parry punches. However, the heavy punching bag support does not provide for lateral motion.

United States Patent Application Publication No. 2017/0036087 discloses an electronic punching bag with a microprocessor. A display screen is disposed around a large portion of the bag. The display screen displays visual signals in response to punches thrown by a user. The bag is not a moving target.

United States Patent Application Publication No. 2016/0059102 discloses a heavy bag workout monitor system comprising impact detection sensors and a workout processor for transmitting workout information during a timed period. The system provides measurements of performance of a user, but does not include a laterally moveable heavy bag.

SUMMARY

Briefly stated, in accordance with the present subject matter, there are provided an apparatus, method, and executable non-transitory programmed medium providing a structure supporting a heavy bag and drive motors to provide multiaxis lateral motion in a horizontal plane. Instrumentation in the bag may operate target lights in the bag to indicate a next hit location. The apparatus offers a user a simulation of an actual boxing match. It can also be used for MMA training with a moving target approximating a real active match. In one form, a user responds to motions of a heavy bag in an X-Y plane whether toward or away from the user. In another form, a heavy bag may be used as a sparring partner. Electronic controls may provide a pre-selected pattern of movement. Various embodiments comprise alternative structures having additional functions to provide meaningful interaction with the user. Additional functions enhancing training include training sequences designed by professional boxers and trainers that can define a shadow boxing exercise, user designed shadow boxing sequences, and add-ons that provide speed bag training or which use a full human dummy which may have a weight within a boxing weight class. Controls may be adaptive to coordinate commands to drive motors in ways such as varying positional displacement of the heavy bag in response to successive blows of increasing speed or magnitude provided by the user. This apparatus offers the novice as well as the professional opportunities to develop and test their strength, stimuli responses, quickness, and skill development.

DETAILED DESCRIPTION

The present subject matter is directed to a heavy bag training device for boxing and other martial arts. The heavy bag is a cylindrical bag which is larger than other types of punching bags. In prior art training devices, the heavy bag may be suspended from an arm. The arm is supported by an upright support rising from legs that rest on the floor. The heavy bag has a very limited range of movement, generally being restricted to pivoting about a support point. A machine containing an automated boxing target moving in an X-Y plane has not been used in training. The present subject matter provides a device that allows for real contact, simulates an actual opponent, and provides enhanced training.

The present apparatus can be used in environments such as studios, gyms, garages, backyards, and living rooms. A rigorous workout and simulation of sparring or fighting can be provided in a 5'×5' area. Alternatively, a larger apparatus could be provided simulating a full-sized boxing ring. The benefits of this apparatus include enhanced training in balance, stamina, body conditioning, hand-eye coordination, and daily workout at different levels of intensity can be effective for beginners to advanced professionals.

A heavy bag support is suspended from a Cartesian gantry. Rails provide for both transverse and longitudinal motion. Electric motors, for example, provide motion of a carriage along an X axis and a Y axis. The present apparatus may utilize stepper motors and encoders, which respond to commands from a control module. The control module dictates the movement of the transverse carriage that supports the heavy bag on a rail on a transport assembly providing X-Y motion. The transverse carriage has the capability to move front to back and left to right along with circular motions. A three dimensional embodiment may be provided with a support including a Z axis drive mounted to the Cartesian gantry. The movement in one embodiment can be controlled by its own control module. A random number generator may be included in the control circuit to command random movements of the carriage. Random movement enhances the user's ability to react to unexpected moves by an opponent. Commands may be embodied in fixed programs. Dynamic commands may be provided through a control unit operable by a trainer observing the user. In another form, the user may provide a user determined routine with commands set by the user. A dedicated, installed control module can be replaced with a separate control module allowing individualized commands from a trainer or a user. In another form, two networked users, each in a separate location may respond to movements of the other user rather than to a control unit.

Figure 1:
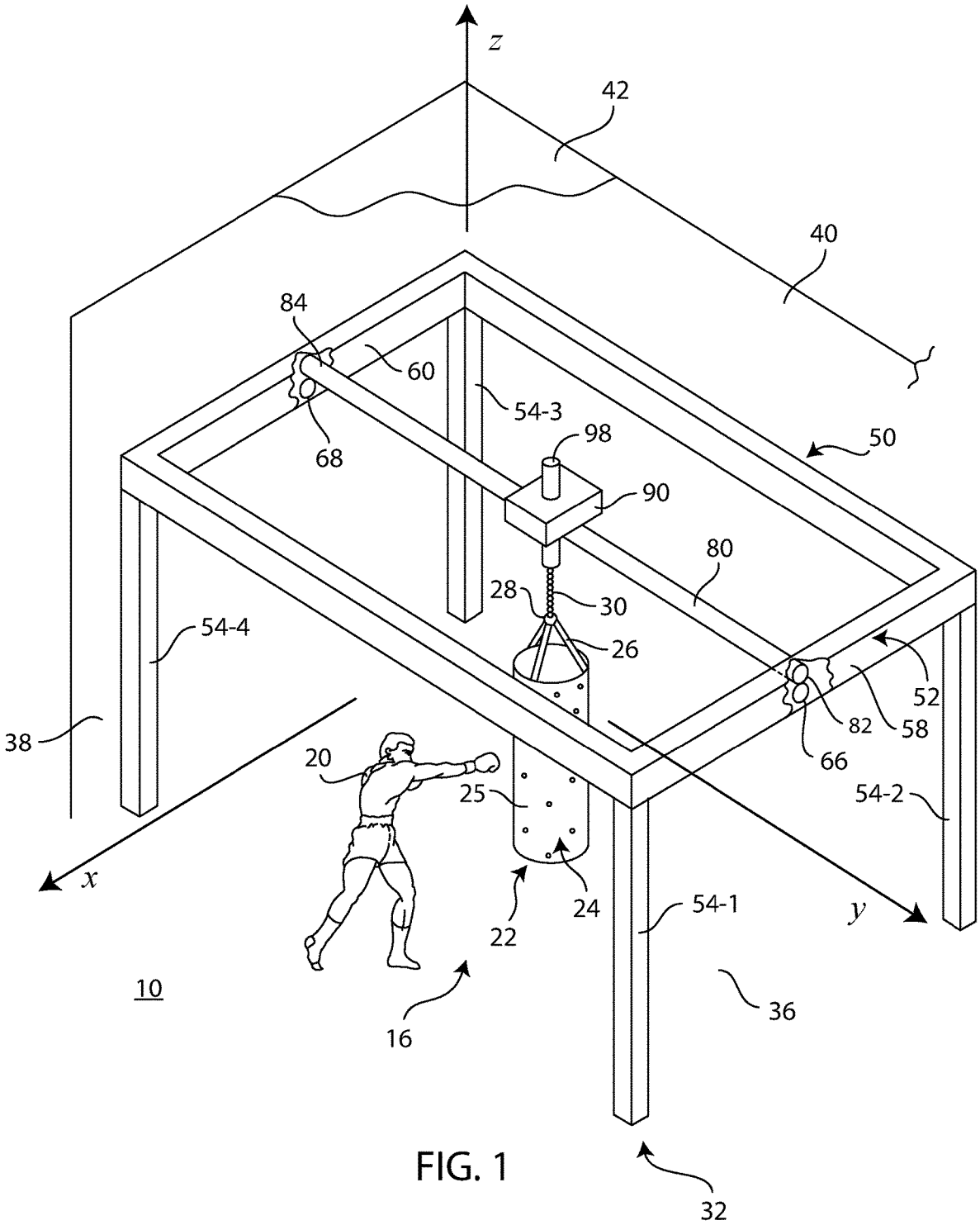
FIG. 1 is an isometric view of a user engaging with an apparatus according to the present subject matter in a training facility.

FIG. 1 is an isometric view of a user 20 engaging with a training apparatus 16 according to the present subject matter in a training facility 10 in which a user 20 is training. The user 20 in many instances will be a boxer. However, training may be done in other martial arts or for physical conditioning. In the present illustration, a target 22 comprises a heavy bag 24. "Heavy bag" is a term of art in the field of athletic equipment. The heavy bag 24 has an outer surface 25. Heavy bags come in different sizes and weights. One nominal heavy bag weighs 100 pounds, is 60" tall, and is 14" in diameter. Bags having other weights are also commercially available. Support straps 26 may be provided each having a first end at the upper diameter of the heavy bag 24 and angularly displaced from a next support strap 26. A second end of each support strap 26 is secured to a mounting ring 28. The mounting ring 28 is suspended from a connector 30. The connector 30 commonly comprises a chain. The connector 30 is a non-rigid member having tensile strength sufficient to support the heavy bag 24 to a framework 50.

The training facility 10 comprises a room 32 generally constructed along orthogonal axes. In the present illustration an X axis represents depth, a Y axis represents width, and a Z axis represents height. Motion along the X axis is referred to as longitudinal, motion along the Y axis is referred to as transverse, and motion along the Z axis is referred to as vertical. A floor 36 is constructed in the X-Y plane. A first wall 38 is constructed in an X-Z plane, and a second wall 40 is constructed in the Y-Z plane. A ceiling 42 is in an X-Z plane vertically displaced from the floor 36.

The heavy bag 24 is supported for movement in orthogonal directions by a framework 50. The framework 50 provides for motion of the heavy bag 24 in the X-Y plane and may also provide for motion along the Z axis. The framework 50 comprises an X-Y Cartesian gantry 52, also known as a 2D gantry 52 or gantry 52. Optional drive means may also be included for moving the heavy bag 24 along the Z axis. In this case, the gantry 52 comprises a 3D gantry. The gantry 52 comprises drives to move the heavy bag 24 and may be referred to as a robot gantry. A robot gantry comprises a manipulator mounted onto an overhead system that allows movement across a horizontal plane. Movement is provided in multiple linear degrees of freedom. Gantry robots are also called Cartesian or linear robots. What makes a Cartesian robot a robot is that the axes perform coordinated motion, through a common motion controller. The gantry 52 comprises vertical supports 54-1, 54-2, 54-3 and 54-4. A first X axis support 58 is mounted atop the vertical supports 54-1 and 54-2. A second X axis support 60 is mounted atop the vertical supports 54-3 and 54-4. The first X axis support 58 and the second X axis support 60 extend along the X axis. A first X drive 66 and a second X drive 68 are mounted to provide relative motion in the X direction between the 1st and 2nd X axis supports and a Y axis support 80. The Y axis support 80 is supported at a first end 82 and a second end 84 by the first X axis support 58 and the second X axis support 60 respectively. As the first X drive 66 and the second X drive 68 are operated, the heavy bag 24 is transported longitudinally in the X dimension.

The first X axis support 58, the second X axis support 60, and the Y axis support need not take any particular form so long as the teachings of the present specification are implemented. The implementations in FIG. 5, FIG. 7, and FIG. 8 exemplify various suitable embodiments.

One advantage of this construction is that it allows construction of a Cartesian gantry having a lateral dimension of 5 feet×5 feet with sufficient room for training movement.

Figure 2:
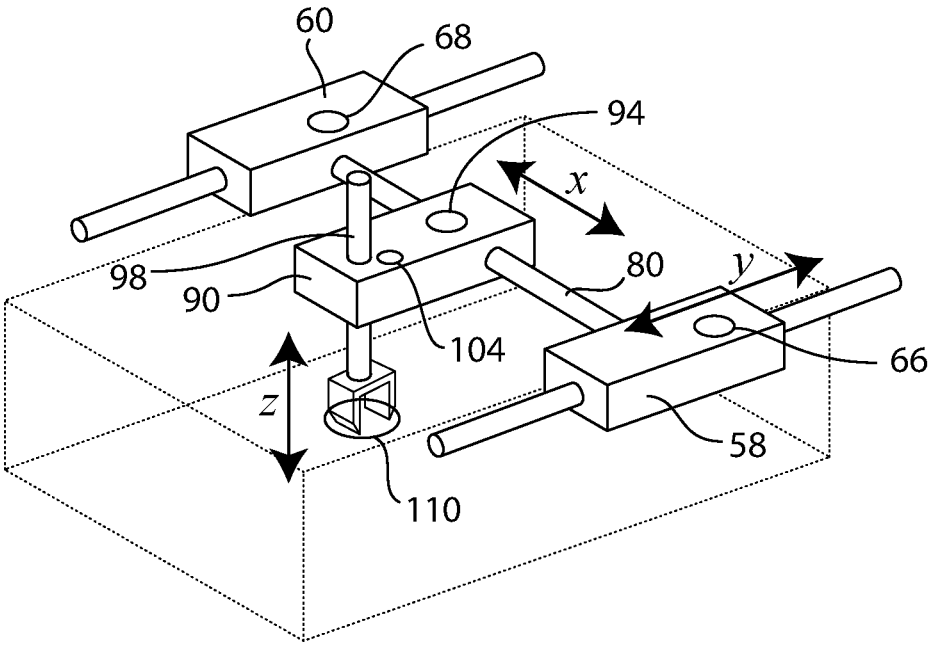
FIG. 2 is a diagram of a partial detailed view of FIG. 1 illustrating motion along three axes.

FIG. 2 is a diagram of a partial detailed view of FIG. 1 illustrating motion along three axes. A support carriage 90 is mounted to the Y axis support 80 for movement in the transverse degree of freedom. The support carriage 90 is releasably secured to an upper end of the connector 30. The support carriage 90 is moved by a Y drive motor 94 providing relative motion between the support carriage 90 and the Y axis support 80. The drive motor 94 may be included in the support carriage 90 or the Y axis support 80. In a 3D embodiment, a vertical support rod 98 is mounted for vertical movement in the support carriage 90. A Z drive motor 104 moves the vertical support rod 98. A lower vertical end of the vertical support rod 98 comprises a latch 110. The upper end of the connector 30 is releasably secured to the latch 110.

X axis longitudinal motion is provided by movement of the Y axis support 80 relative to the first X axis support 58 and the second x axis support 60. Y axis transverse motion is provided by movement of the support carriage 90 with respect to the Y axis support 80. Z axis vertical motion is provided by movement of the vertical support rod 98 with respect to the support carriage 90.

Figure 10:
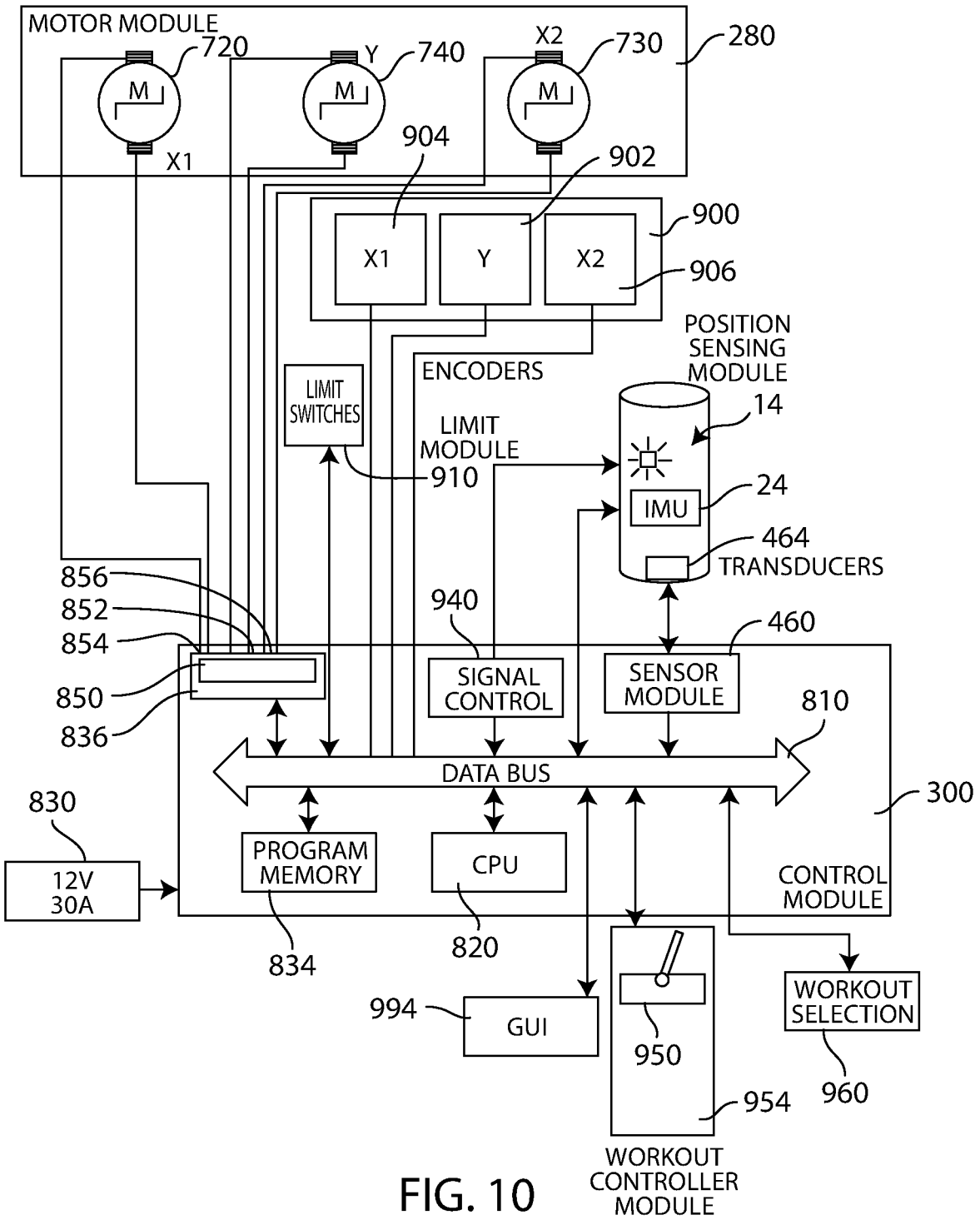
FIG. 10 is a block diagram of one preferred form of an electrical circuit of the training apparatus.

The first and second X drive motors 66 and 68, the Y drive motor 94, and the Z drive motor 104 are operated by the system described with respect to FIG. 10. The X drive motors 66 and 68 and the Y drive motor 94 are mechanically coupled to move the support carriage 90 with respect to each of the orthogonal axes.

Figure 3:
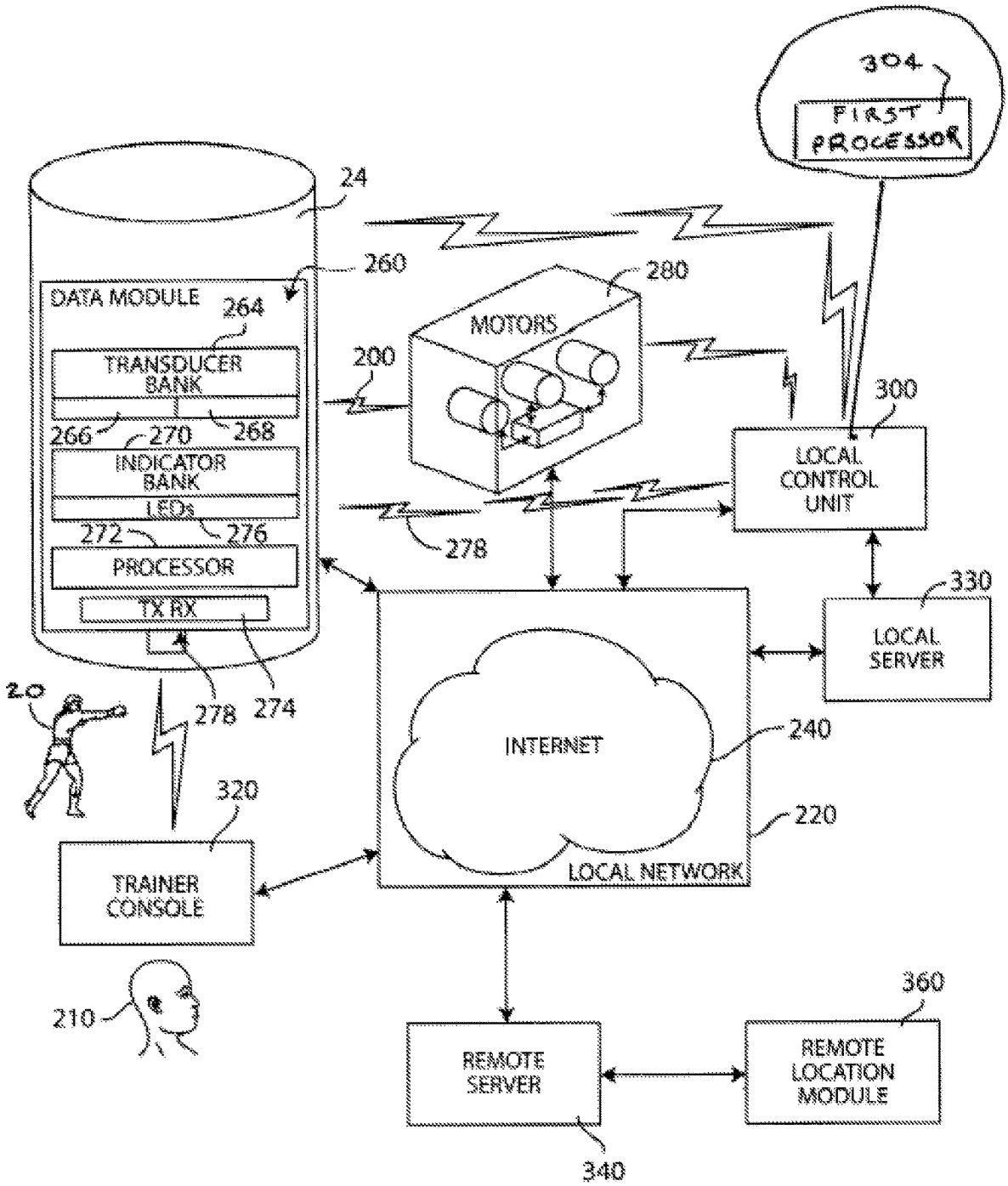
FIG. 3 is a block diagram illustrating interactions within a system according to the present subject matter.

FIG. 3 is a block diagram illustrating interactions within a system according to the present subject matter. Communications are provided between various subsystems. The various subsystems include data module 260 in the hanging bag 24, motor module 280, local control unit 300, a trainer console 320, a local server 330, a remote server 340, and a remote location module 360. Communications may be provided by local RF links 278, local networks 220, and the Internet 240. The local control unit provides motion commands to said drive motors. The local control unit 300 compares signals received from the heavy bag 24 to stored values indicative of the preselected training exercise. The comparison is used to establish performance data. The performance data is processed to modify commands to be provided to the drive motors. A first processor 304 compares information from the transducer bank 264 to a set of preselected set of instructions and modifies movement commands to the Cartesian gantry 52. Commands are coupled from the first processor 304 to the heavy bag 24. The first processor 304 in the local control unit 300 is responsive to inputs to provide data to said local control unit for translation into motion commands.

The data module 260 comprises a transducer bank 264, an indicator bank 270, a second processor 272, and a transceiver 274. The transducer bank 264 provides signals indicative of physical parameters encountered by the heavy bag 24. The transducer bank 264 includes transducers comprising accelerometers 266 for responding to impacts made by the user 20 when striking the heavy bag 24. Outputs from the transducer bank 264 are coupled to the local control circuitry 300. The accelerometers 266 produce outputs in response to blows of a user delivered to the heavy bag. Also a timing circuit 268 in the transducer bank 264 records the occurrence of blows. This may inform the trainer 210 of information relative to strength, timing, and technique of the user 20. The indicator bank 270 generally comprises optical devices such as light emitting diodes (LEDs) 276. The transducers in the heavy bag provide information to a local control unit 300. The indicators receive information from the local control unit 300. The LEDs 276 provide functions such as informing the user 20 of locations where a blow has landed, informing the user 20 of locations where a training program is instructing the user 20 to hit, and informing the user 20 of achieving training goals provided from other subsystems. The indicator bank 270 receives input information from the local control unit 300. The second processor 272 processes data to inform other subsystems of selected data and receives commands which are translated to operating signals to the other devices in the data module 260. The second processor 272 executes commands provided by the local control unit 300. The second processor 272 is coupled to the indicator bank 270 to translate programmed actions to indications on said heavy bag. The second processor 272 also receives inputs from the transducer bank 264 and provides current information to the local control unit 300. The local control unit has an input for receiving signals from the heavy bag 24. In this manner the local control unit 300 is coupled to receive input signals indicative of interaction between a heavy bag 24 and a user 20. The signals received at the local control unit 300 are compared in the first processor 304 to values indicative of the preselected training exercise. Comparisons include location of blows, timing of blows, and intensity of blows. The transceiver 274 provides RF communication via an RF link 278 with other modules and also serves as a modem for network communications. Communications with other modules may also be provided via the local network 220.

The motor module 280 receives signals indicative of commanded motion and position of each of the drive motors 66, 68, 94, and 104. Generally, the command signals will be provided by the local control unit 300. Motion commands may also be provided from the local server 330, the trainer console 320, and the remote server 340. The motor module 280 responds to command signals to produce voltages for operating each motor. The motor module 280 also transmit signals indicative of actual positions of the drive motors. The drive motor position signals can be processed to indicate a jam in motor movement. One preferred form of motor is a DC stepper motor and the operating voltages are DC pulses. Operation of the motor module 280 is further described with respect to FIG. 9, FIG. 10, and FIG. 11.

The local control unit 300 produces commands and provides information to the data module 260. Commands may come from a preloaded program or may be generated in real time. The trainer console 320 is used by a trainer 210 for direct interaction with the hanging bag 24 and the user 20. The trainer console 320 preferably comprises a personal computer having wireless network capability. The trainer console 320 is interactively coupled with the local control unit 300 to enable production of real-time commands by a trainer 210. The trainer 210 may track progress of the user 20 and may create new programs or modify existing programs for driving motion of the bag 24. The local server 330 includes a library of programs which may be selectively provided to the local control unit 300.

The remote server 340 provides for networking with remote locations. A physical fitness chain may receive inputs from each of a number of training facilities 10 and aggregate data for large numbers of users 20. The remote location module 360 is substantially a duplicate of the system of this FIG. 3, but at a remote training facility 10. Control signals may be communicated via the Internet 240 to provide the operation described with respect to FIG. 15.

Figure 4:
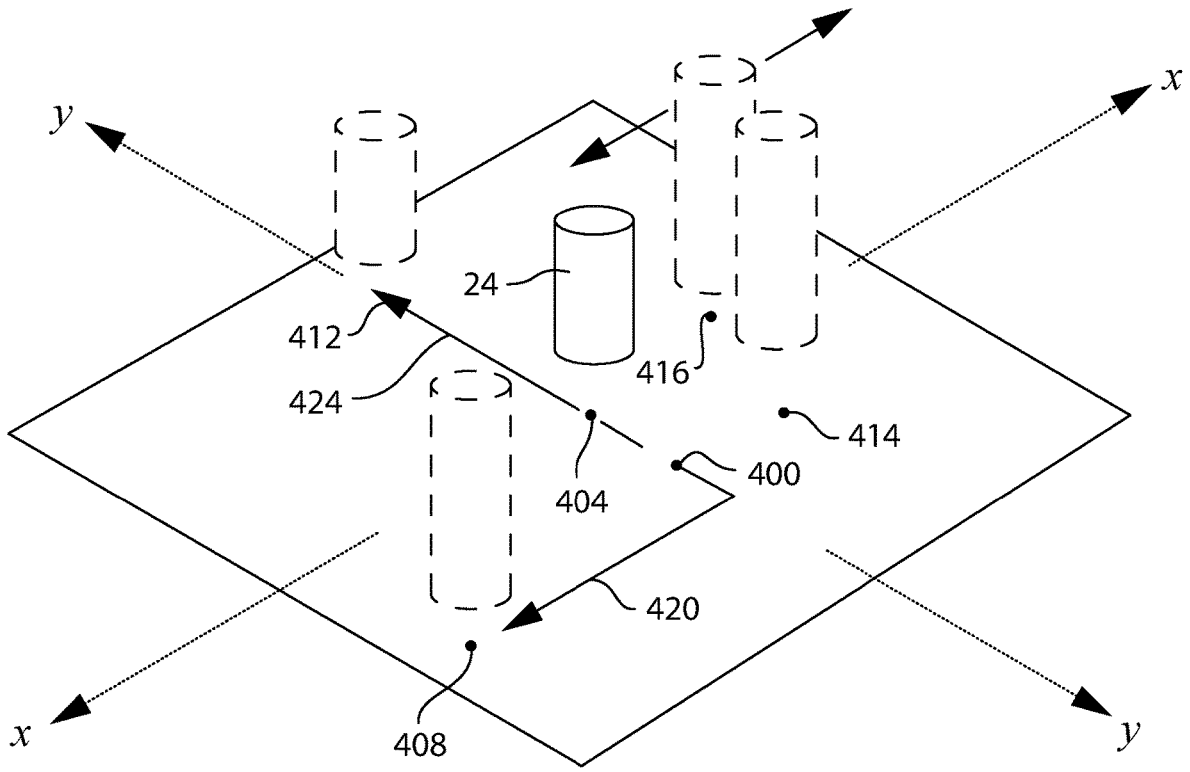
FIG. 4 is an isometric illustration of a heavy bag in selected alternate positions to which the bag can move.

FIG. 4 is an isometric illustration of a heavy bag in selected alternate positions to which the bag can move. In this illustration the user 20 assumes an initial position 400 facing the heavy bag 24. The heavy bag 24 is at an initial position 404. The user 20 will engage with the heavy bag 24 from this position 400. Alternative positions of the heavy bag 24 are illustrated in dashed lines. The heavy bag 24 may be programmed to move to a second position 408 to the left of the initial position 404. In order to continue facing the heavy bag 24, the user 20 needs to move along a path 420 to the left and step back. This enables the user 20 to be in front of the heavy bag 24 in its new position 408. Movement to a third position 412 simulates an opponent backing away from the user 20. The user 20 needs to step forward along a path 424 to maintain engagement with the heavy bag 24. Movement to a fourth position 414 simulates motion of an opponent moving so that the user 20 must turn to face the opponent. Movement to a fifth position 416 simulates the opponent closing in on the user 20. The user 20 has to assume a defensive stance. The carriage 90 is controlled to move to any number of locations in response to control signals.

Figure 5:
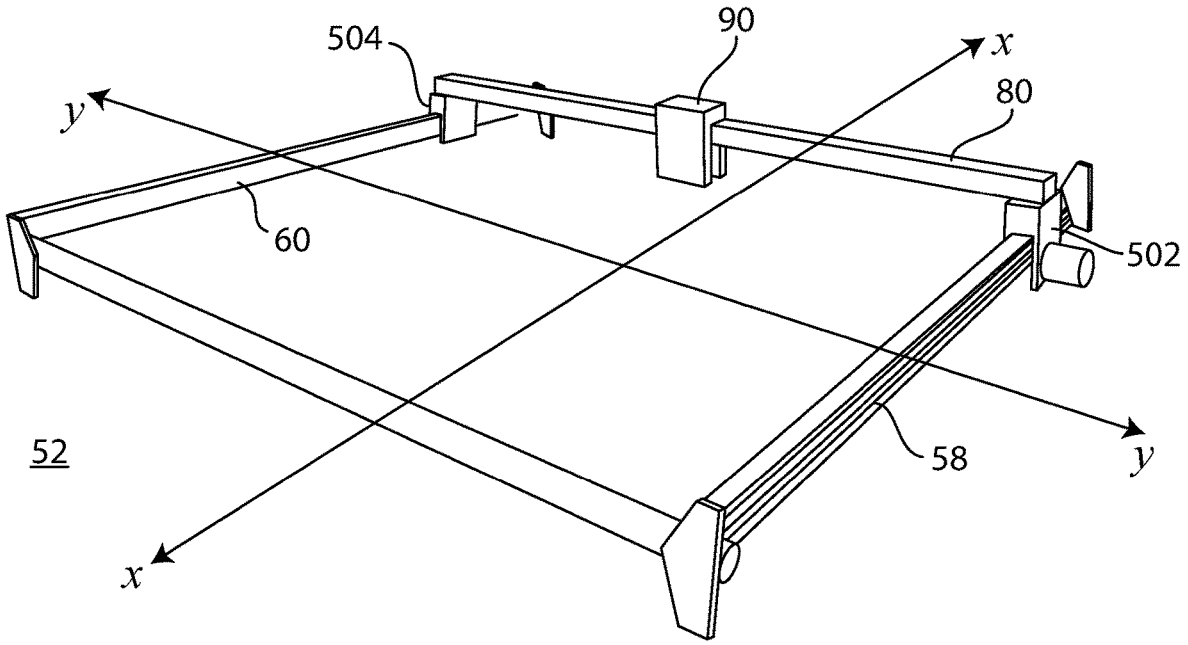
FIG. 5 is a perspective view of the Cartesian gantry including tracks for motion in the X, Y, and Z dimensions.

FIG. 5 is a perspective view of the Cartesian gantry 52 including tracks for motion in the X, Y, and Z dimensions. Providing motion in the Z dimension is optional. A Cartesian gantry is a support and positioning system whose three principal axes of control are linear and are orthogonal. Rotation is not provided. The Cartesian gantry 52 may be built using extruded steel beams and rolled steel tubing with welded reinforced joints. The first X axis support 58 and the second X axis support 60 may each be a rail. The first X axis support 58 and the second X axis support 60 each comprise drive mechanisms that work together to move the Y axis support 80 in the longitudinal direction. Drive mechanisms are further described with respect to FIG. 7 and FIG. 8. In the present illustration, the Y axis support 80 comprises a transit rail on which the carriage 90 travels. A first drive support coupling 502 couples the Y axis support 80 for relative motion with the first X axis support 58. A second drive support coupling 504 couples the Y axis support 80 for relative motion with the second X axis support 60. Driving force between ends of the Y axis support 80 and the first and second X axis supports 58 and 60 is coordinated so that the Y axis support 80 remains orthogonal to the X axis. The relative motion is the longitudinal travel of the Y axis support 80. The longitudinal movement defines the X coordinate of the position of the heavy bag 24 (FIG. 1). The support carriage 90 travels in the transverse direction on the transit rail comprising the Y axis support 80. The position of the support carriage 90 defines the Y coordinate of the heavy bag 24. Combinations of X movement and Y movement may move the heavy bag 24 along arcs or in circles.

Figure 6:
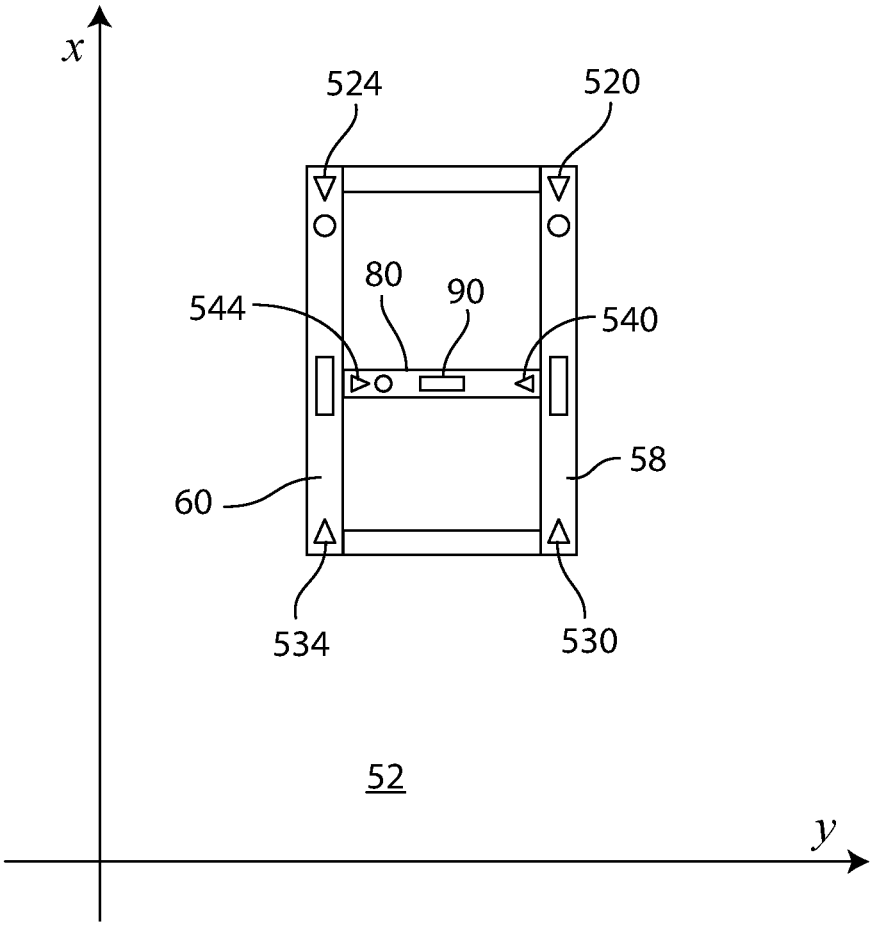
FIG. 6 is a plan view of the Cartesian gantry.

FIG. 6 is a plan view of the Cartesian gantry 52 shown in relation to the X axis and the Y axis. FIG. 6 further illustrates switches for limiting the extremes of movement of the Y axis support 80 and the support carriage 90. The Y axis support 80 extends transversely between the first X axis support 58 and the second X axis support 60. A first limit switch 520 and a second limit switch 524 are located adjacent a first end of the first X axis support 58 and the first end of the second X axis support 60, respectively. When the Y axis support 80 travels to a first extreme of transverse motion, it engages the limit switches 520 and 524 to open them. Drive motors are de-energized. A third limit switch 530 and a fourth limit switch 534 are located adjacent a second end of the first X axis support 58 and the second end of the second X axis support 60, respectively. When the Y axis support 80 travels to an opposite extreme of its longitudinal travel, it opens the third limit switch 530 and the fourth limit switch 534. Because a positive action de-energizes drive means, separate travel measurement circuitry and overcurrent monitoring in response to a blocked movement of a motor are not required.

A fifth limit switch 540 is located on the Y axis support 80 adjacent the first X axis support 58. A sixth limit switch 544 is located on the Y axis support 80 adjacent the second X axis support 60. Each of the switches 540 and 544 is operated when engaged by the support carriage 90 to de-energize the drive motor 94 (FIG. 2).

Figure 7:
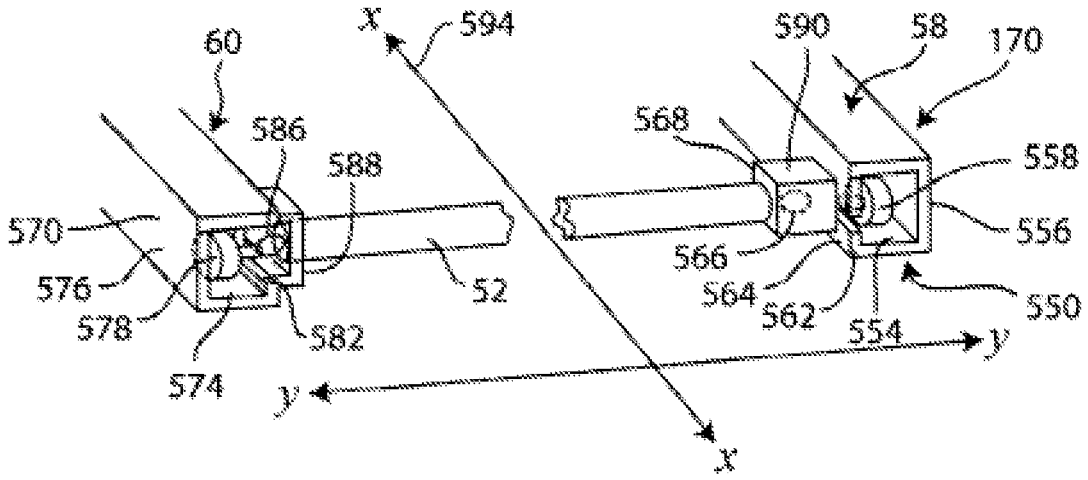
FIG. 7 is a partial detailed view, partially broken away, of FIG. 5 illustrating one form of rail assembly and motors driving the heavy bag along an X axis.

FIG. 7 is a partial detailed view, partially broken away, of FIG. 5 illustrating one form of rail assembly and motors driving the heavy bag 24 along an X-axis. In this embodiment, the first X axis support 58 takes the form of a C-shaped rail 550. The C-shaped rail 550 has a first inner track 554 extending in the X direction. A first drive wheel 558 rests in the first inner track 554. The first drive wheel 558 is confined for motion along the X axis by a first vertical sidewall 556. The first drive wheel 558 is constrained on an inner side of the C-shaped rail 550 and by a first lip 562 on an inner side. The first drive wheel 558 is driven by a stepper motor 566 inside a first stepper motor housing 568. Similarly, the second X axis support 60 takes the form of a second C-shaped rail 570. The C-shaped rail 570 has a second inner track 574 extending in the X direction. A second drive wheel 578 rests in the second inner track 574. The second drive wheel 578 is confined for motion along the X axis by a second vertical sidewall 576 on an outer side of the C-shaped rail 570 and by a second lip 582 on an inner side. The second drive wheel 578 is driven by a second stepper motor 586 inside a second stepper motor housing 588. The first stepper motor housing 568 includes a rotary encoder 590. The second stepper motor housing 588 includes a rotary encoder 594. In this embodiment driving force is applied directly to moving supports inside respective tracks. In other embodiments driving force may be applied to pulleys having a cable, where each end of the driven object is connected to a cable.

Figure 8:
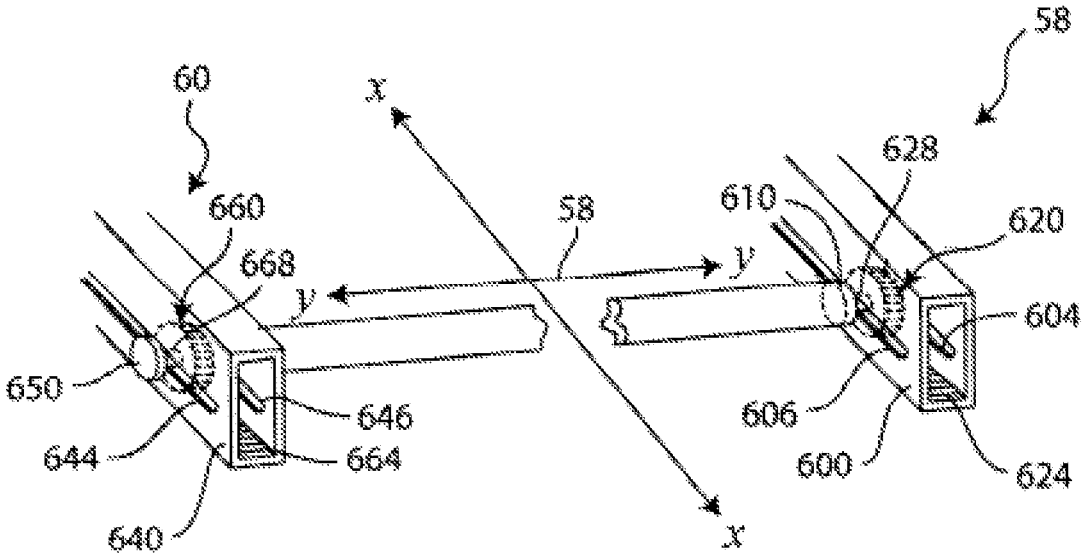
FIG. 8 is a partial detailed view, partially broken away, of FIG. 5 illustrating an alternative form of rail assembly and motors driving the heavy bag along the X axis.

FIG. 8 is a partial detailed view, partially broken away, of FIG. 5 illustrating an alternative form of rail assembly and motors driving the heavy bag along the X axis. In this embodiment, the first X axis support 58 takes the form of a first hollow rail 600. The second X axis support 60 takes the form of a second hollow rail 640. In one preferred embodiment, the first hollow rail 600 has a rectangular cross-section. The first hollow rail 600 has a first outer longitudinal slot 604 and first inner longitudinal slot 606 extending in the X direction. The slots 604 and 606 support an axle 610. The first axle 610 moves along the length of the first hollow rail 600 within the slots 604 and 606. A first rack and pinion mechanism 620 provides longitudinal motion along the X axis. A first rack 624 is provided extending the length of the first hollow rail 600. A first pinion gear 628 rotates around the first axle 610.

In one preferred embodiment, the second hollow rail 640 has a rectangular cross-section. The second hollow rail 640 has a second outer longitudinal slot 644 and second inner longitudinal slot 646 extending in the X direction. The first and second slots 644 and 646 support a second axle 650. The second axle 650 moves along the length of the second hollow rail 640 within the slots 644 and 646. A second rack and pinion mechanism 660 provides longitudinal motion along the X axis. A second rack 664 is provided extending the length of the second hollow rail 640. A second pinion gear 668 rotates around the second axle 650.

The first axle 610 and the second axle 650 may be driven by stepper motors such as the stepper motor 566 and stepper motor 586, respectively, as seen in FIG. 7. Rotary encoders in the embodiment of FIG. 8 (not shown) such as the rotary encoders 590 and 594 of FIG. 7 are used to track angular position and number of rotations of drive motors so that longitudinal displacement of opposite transverse ends of the Y axis support 80 remain equal.

Figure 9:
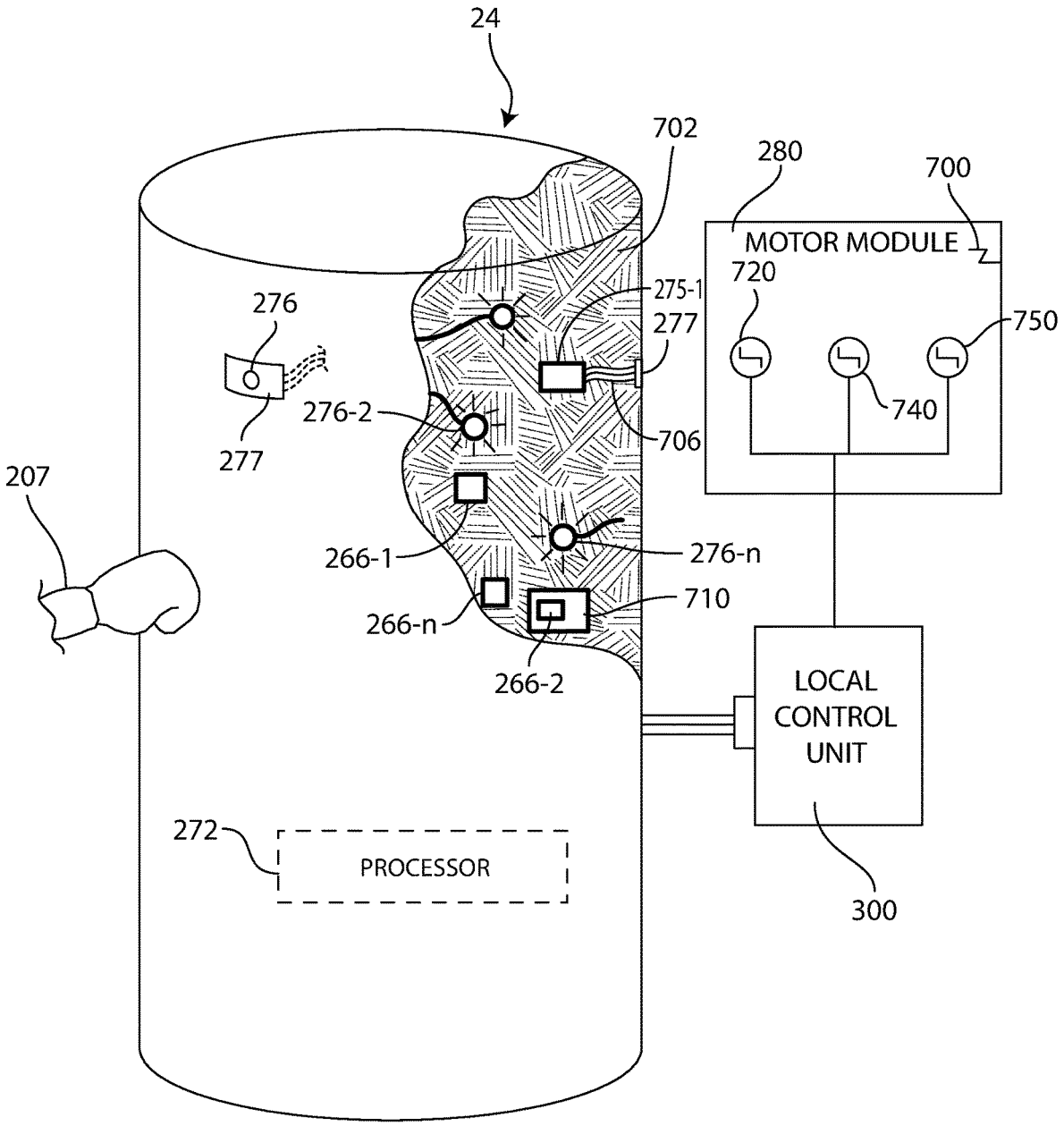
FIG. 9 is a block diagram partially broken away of an instrumented heavy bag interacting with control and drive circuitry.

FIG. 9 is a block diagram partially broken away of an instrumented heavy bag 24 interacting with control and drive circuitry. The transducer bank 264 (FIG. 3) comprises a plurality of transducers placed in the heavy bag 24. The transducer bank 264 includes a plurality of accelerometers 266-1 to **266-*n*, where n is an integer. The accelerometers 266 are placed in positions to respond to blows delivered by the user 20. A greater concentration of accelerometers 266 may be provided in areas which generally receive the most contact. In this manner, greater resolution in location and intensity of hits is provided in areas where the output is most meaningful. A lower density of accelerometers 266 may be placed in areas adjacent vertical extremities of the heavy bag 24. Positions of each sensor may be programmed in the second processor 272. Alternatively, each accelerometer 266 may be encoded with its position and provide a digital code along with an output signal indicative of force. Outputs of multiple accelerometers 266 may be processed to refine intensity and location information. Outputs of the accelerometers 266 may be compared to stored values, the stored values comprising criteria to evaluate if the force of the punches delivered by the user 20 is sufficient to meet a performance objective. The transducer bank 264** is coupled to the local control unit to provide data for comparison to criteria indicative of performance of the user. Audio could be provided to simulate sounds of a gymnasium or to perform other functions.

Instrumentation provides many different interactions with a user 20. A program training sequence may be provided. The indicator bank 270 comprises a plurality of light indicators 275. Each light indicator 275 may comprise a traditional lightbulb, a light emitting diode (LED), or other radiation source. Generally, the light indicator 275 will provide visible light. One preferred form of light indicator 275 is an LED 276. LEDs 276 are distributed over a plurality of locations on the heavy bag 24. Each LED 276 is located adjacent the outer surface 25. The LEDs 276 in one form are seen through the outer surface 25. Alternatively, the LEDs 276 may each be placed adjacent a window 277. The sequence is dictated by a training program or by real time selections of the trainer 210. However, other sources could be used. For example, infrared (IR) could be used so that radiation may be viewed by a trainer 210 using an IR sensor but not be visible to the user 20. The plurality of light indicators 275 are denoted 275-1 through **275-*n*, where n is an integer. The light indicators 275 may be supported to a web 702 formed in the heavy bag 24. Light indicators 275 are included adjacent an outer surface of the heavy bag 24 to convey light from each light indicator 275 when it is activated. The light indicators 275 for other sources such as IR may comprise a translucent or transparent window 277. Alternatively, the light indicator 275 may further comprise a fiber optic bundle 706 which transmits light from a light indicator 275. Impact sensors 710, such as an accelerometer 266, are included to register impact from punches by a user 20. Individual accelerometers 266 may be connected to the transducer bank 264. Alternatively, pluralities of impact sensors 710 may be interconnected to respond to various force vectors produced by a punch of the user 20. The transducer bank 264 may further comprise timers to calculate frequency of punches. The timers 268** may also be used to record timing of punch combinations.

Impact sensors 710 respond to hits on the heavy bag 24 by the user 20 in accordance with a preselected set of responses for each impact. The motor module 280 comprises first and second X axis stepper motors 720 and 730, Y axis stepper motor 740, and an optional Z axis stepper motor 750. Impact information may be provided to the local control unit 300 which may translate impact information into motion command signals for the stepper motors 720, 730, 740, and 750 in accordance with a preselected program. Alternatively, the stepper motors 720, 730, 740, and 750 may respond to the control circuitry 300 to move the heavy bag 24.

FIG. 10 is a block diagram of one preferred form of an electrical circuit of the training apparatus 16. The control module 300 provides for interaction between the user 20 and the heavy bag 24. Communications within the control module 300 are provided by a data bus 810. A central processing unit (CPU) 820 provides commands and receives data. One preferred form of the CPU 820 is a 16-MHz Arduino Mega microcontroller, which will function as an integrated system controller. Power will be provided by a 12-volt, 30-amp AC/DC supply 830. A program memory 834 stores a program to command a preprogrammed workout. The preprogrammed workout may comprise a preselected training exercise. The program memory 834 is shown as a discrete component for the purposes of illustration. However, in most embodiments, the program memory 834 will comprise part of the CPU 820. The program memory 834 provides sequential signals indicative of commanded movements of the drive motors 720, 730, and 740. Additionally, commands are provided to the drive motor 750 in embodiments in which the drive motor 750 is included.

Drive power is preferably provided to stepper motors in the motor module 280 via a motor drive circuit 836. A Y-axis stepper motor 740 moves the support carriage 90 (FIG. 2). The first X axis stepper motor 720 drives the first transverse end of the Y axis support 80. A second X axis stepper motor 730 drives the opposite end of the Y axis support 80. Commands are provided from the CPU 820 via the data bus 810 to a motor decoder 850. The motor decoder 850 has a first pair of terminals 852 connecting a voltage across the Y stepper motor 740. A second pair of terminals 854 connects a voltage across the first X stepper motor 720, and a third pair of terminals 856 connects a voltage across the second X stepper motor 730. In the present embodiment a Z stepper motor is not included.

A position sensing module 900 includes a first encoder 902, a second encoder 904, and a third encoder 906. The first encoder 902 provides an output indicative of a position of the support carriage 90. The second encoder 904 and the third encoder 906 respectively provide an output indicative of the X position of opposite transverse ends of the Y axis support 80. A limit module 910 constrains the extent of longitudinal displacement of the Y axis support 80. The limit module 910 comprises the first limit switch 520 (FIG. 6), the second limit switch 524, the third limit switch 530, and the fourth limit switch 534. The fifth limit switch 540 and sixth limit switch 544, limit transverse motion of the support carriage 90 and are also included in the limit module 910.

A signal control module 940 is coupled between the heavy bag 24 and the data bus 810. The signal module 940 may comprise light control signals, sound control signals, or other signals provided to instrumentation in the heavy bag 24. The transducer bank 264 (FIG. 3) is coupled from the heavy bag 24 to the data bus 810. All software may be programmed within the Arduino Mega environment, with focus on sensor integration. In one preferred embodiment, training sequences will be controlled by a manual joystick 950 or by pre-programmed routines. A workout controller 954 may be provided for the trainer 210 to command motion of the heavy bag 24 to determine the workout of the user 20 in real time. A workout selection module 960 provides for selection of the real time workout or a workout defined by a program in the program memory 834.

A closed loop is provided to measure errors between the commands provided to the motor module 280 and the CPU 820. Performance of the user 20 is measured by the transducer bank 264 and may be reported to the user 20 or to the trainer 210. Reports may be provided via a graphical user interface (GUI) 994 of performance of the user 20 and selected training programs. The graphical user 994 interface is coupled to the local control circuit 300. The graphical user interface 994 is connected to networks 220 and 240 to allow a user to remotely monitor and control the heavy bag 24. Training data is collected that will gauge accuracy, speed, force, and other relevant metrics, allowing the user 20 to see performance increases and areas for improvement.

Figure 11:
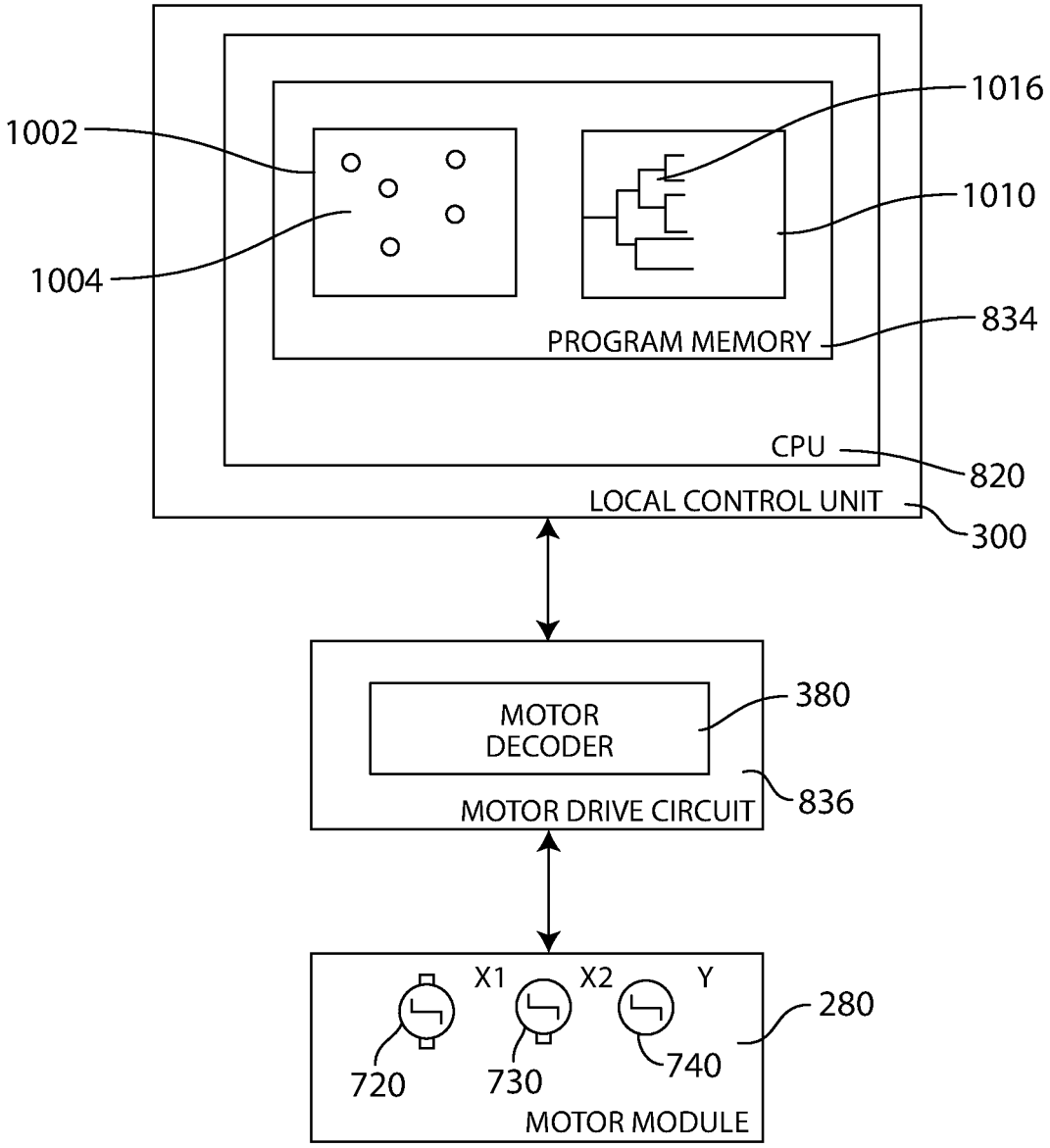
FIG. 11 is a block diagram illustrating programs embodied in a program memory in the CPU.

FIG. 11 is a block diagram illustrating programs embodied in the program memory 834 in the CPU 820. The program memory comprises a source to provide command data to the local control unit 300. The programs illustrated are only examples of training programs. Programs may be preprogrammed in a fixed pattern, preprogrammed to react to actions of a user 20, or may be downloaded or obtained from other sources.

The maker of the training apparatus 16 in one embodiment has training sequences designed by professional boxers and trainers. These training sequences can be embodied in programs stored in the local server 330 or the remote server 340 (FIG. 3) and provided for download for use in the training apparatus 16. A website app is provided to enable users 20 to design a training sequence and translate the sequence into a program. The training apparatus 16 in one embodiment allows for add-ons, such as, programming speed bag training.

A first program 1002 defines a succession 1004 of programmed positions for the heavy bag 24. A second, dynamic program 1010 provides a decision tree 1016 which produces commands to move the heavy bag 24 to a position selected in response to a current hit by the user 20. The decision tree 1016 may include branches that lead to an endpoint. Other branches may move the current position selection to an earlier decision point. The trainer 210 may select which of the programs 1002 or 1010 is used.

In the program 1002 selected positions are programmed to provide a moving target with the heavy bag 24 assuming successive positions. The program 1002 may vary such parameters as speed of movement, extent of movement, and frequency of movement of the heavy bag 24. Measured performance is entered into the CPU 820 for comparison with desired values of criteria associated with a current decision point in the decision tree 1016. This will allow for trainers 210 of professional fighters to judge their proficiency to go up against other opponents. This can help customize training for particular bouts.

Figure 12:
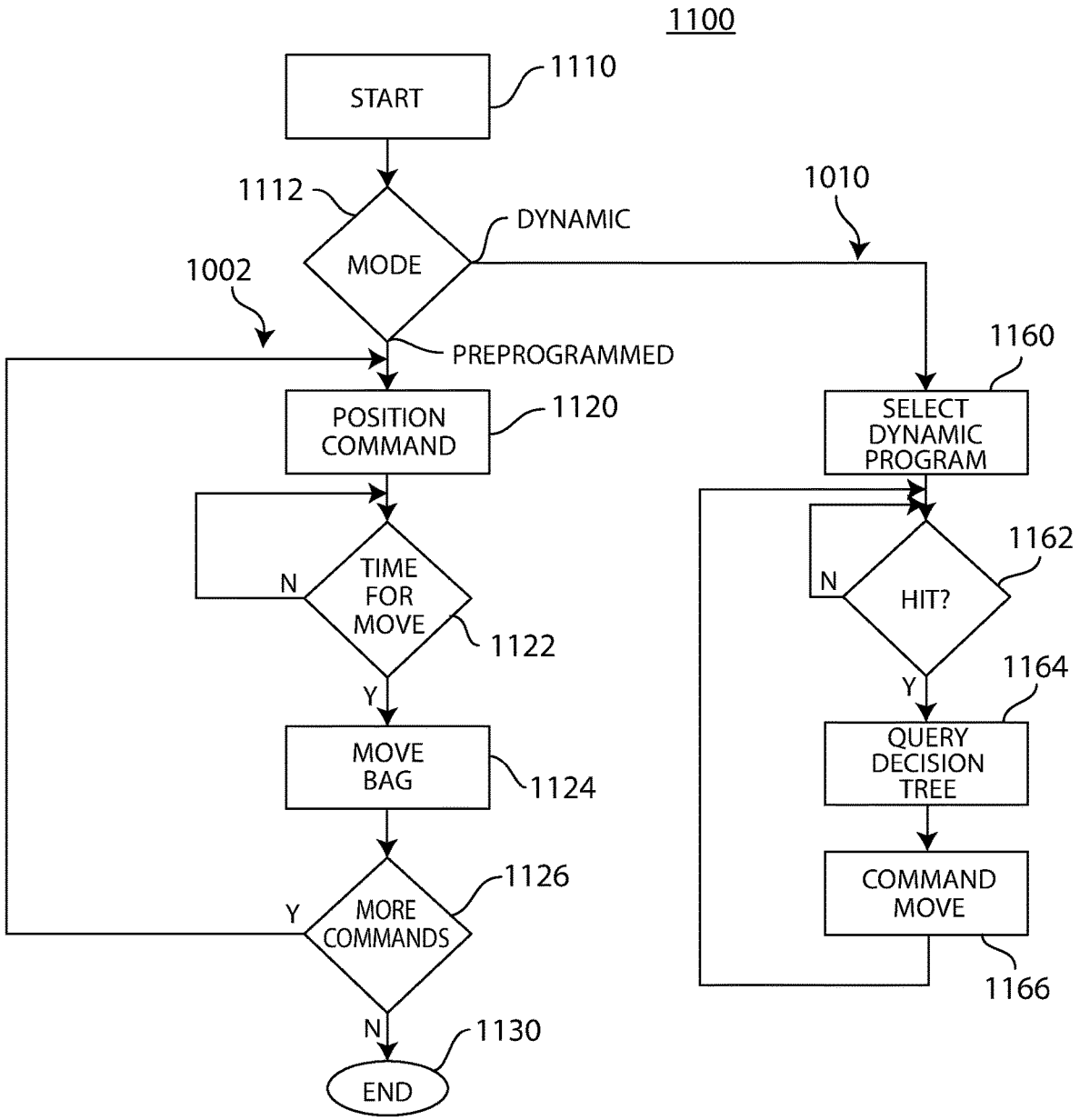
FIG. 12 is a flowchart of a non-transitory programmed medium which when executed on a digital processor causes the apparatus to provide a preselected automated workout for the user.

FIG. 12 is a flowchart of a non-transitory programmed medium 1100 which when executed on a digital processor causes the apparatus to provide a preselected automated workout for the user 20. Operation begins at block 1110. At block 1112, the program 1002 or the dynamic program 1010 is selected. If program 1002 is selected, operation proceeds to block 1120. An initial position of the heavy bag 24 is commanded. At block 1122, the system responds to a timer to determine when a next move of the heavy bag 24 is executed. A preprogrammed time duration is defined between each movement of the heavy bag 24. If the preprogrammed time duration has elapsed, at block 1124, the heavy bag 24 is moved. If preprogrammed time duration has not completely elapsed, operation returns to the input of block 1122. A new comparison of the currently elapsed time is again compared to the programmed time duration. At block 1126, a determination is made if there are more commands to be issued to the motor module 286 to move the heavy bag 24. If so, operation returns to block 1120. If not, operation ends at block 1130.

If the dynamic program 1010 is selected, operation proceeds to block 1160. The program 1010 is executed. At block 1162, the control circuit 300 is queried to determine if there was a hit. If not, operation returns to the input of block 1162. If a hit is registered, operation proceeds to block 1164 where the decision tree 1016 state is updated and a next move is commanded at block 1166. After block 1166 operation returns to the input of block 1162 to continue responses to the user 20's punches. The decision tree 1016 can be set up to simulate responses of different boxers to the same punch thrown by the user 20 by moving the heavy bag 24 in a manner in which the other boxer is known to respond.

Figure 13:
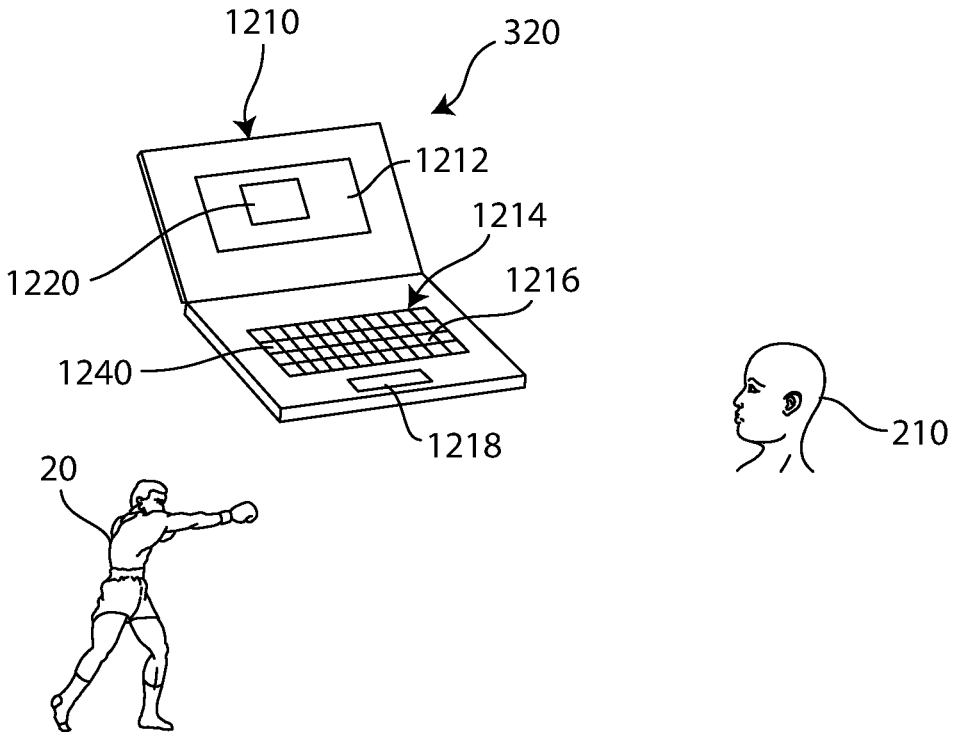
FIG. 13 is an isometric view of a trainer console for use by a trainer in fashioning a workout for the user in real time.

FIG. 13 is an isometric view of the trainer console 320 for use by a trainer 210 in fashioning a workout for the user 20 in real time. In the present embodiment, the trainer console 320 comprises a laptop computer 1210 having a display 1212 and data entry means 1214. The data entry means 1214 generally comprises a keyboard 1216 and a mouse 1218. The trainer 210 works through the data entry means 1214 to enter commands and information and receives data from the display 1212. The program memory provides a succession of GUIs 1220. Separate GUIs 1220 may be provided for programming motion of the heavy bag 24, entering data defining identity and characteristics of the user 20, reporting performance of the training apparatus 16 and of the user 20, and reporting time periods and other parameters describing performance of the user 20 and the workout. The trainer console 320 may be embodied in a tablet computer, smart phone, or handheld remote controller. The trainer console 320 has the ability to dictate movement of the heavy bag 24 on the Cartesian gantry 52. The Cartesian gantry 52 has the capability to move front to back and left to right along with circular motions. There is no limitation of movement. A random number generator 1240 may be used in creating programs so that random movement of the heavy bag 24 can be generated. The local control unit 300 can be partially disabled to allow the trainer console 320 to command all movements of the heavy bag 24.

Figure 14:
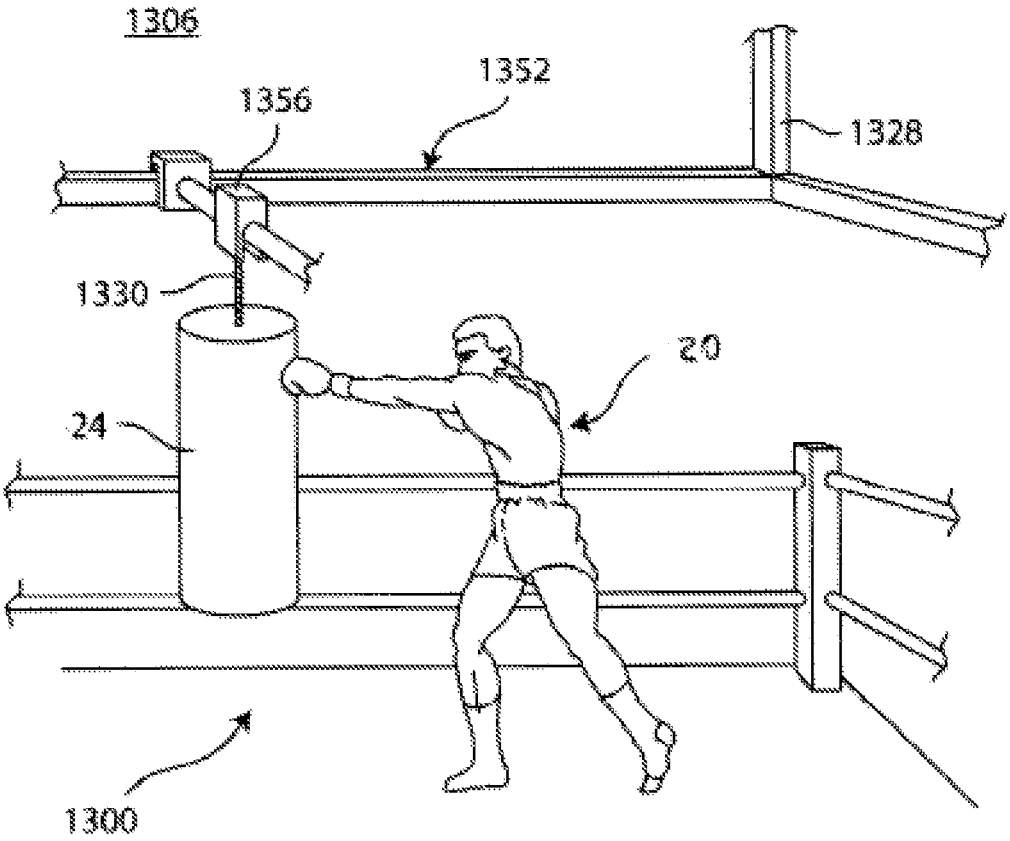
FIG. 14 is an illustration of an embodiment including a full-sized boxing ring for simulated sparring.

FIG. 14 is an illustration of an embodiment including a full-sized boxing ring 1300 for simulated sparring. A user 20 spars with a heavy bag 24. In one embodiment the heavy bag 24 comprises a full human dummy that may be the size and weight of a particular class of boxer, e.g., welter weight or middle weight.

The heavy bag 24 is suspended by a connector 1330. Connector 1330 is connected to a support carriage 1356 in a Cartesian gantry 1352. The Cartesian gantry 1352 may be supported by an upright beam 1328 for support to a ceiling or tier (not shown) of the boxing venue 1306. This embodiment allows the user 20 to display and utilize all skills learned in the training program. It can allow a beginner to develop experience which normally could not be provided until the beginner would reach a higher level of experience. This system can also be used as a simulator for a totally untrained person. The boxing experience provided is analogous to mechanical bull riding in which a totally unskilled person may participate in a difficult activity with essentially no risk of injury. Use of the system dramatically enhances the ability of a trainer 210 to evaluate a fighter's suitability for advancing to a higher level.

Figure 15:
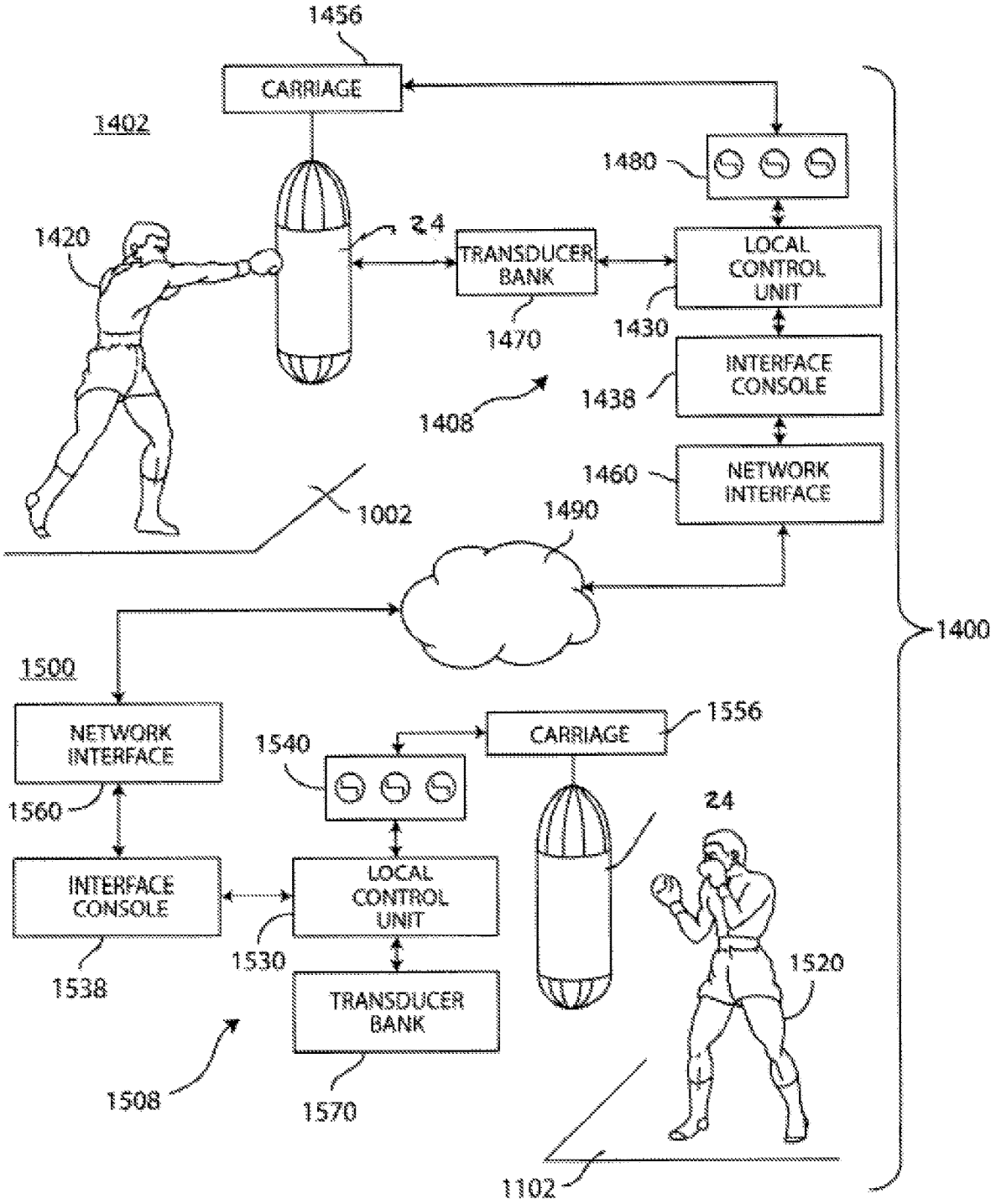
FIG. 15 is an illustration of an apparatus enabling sparring between a first user and a second user each at a location remote from the other.

FIG. 15 is an illustration of an apparatus 1400 enabling sparring between a local user 1420 and a remote user 1520 each at a location remote from the other. The local user 1420 at a first location 1402 interacts with a system 1408 which operates a heavy bag 24. The heavy bag 24 is suspended from a support carriage 1456. The support carriage 1456 is driven by a motor module 1480. A transducer bank 1470 exchanges information with the heavy bag 24. The motor module 1480 and the transducer bank 1470 interact with a local control unit 1430. The local control unit 1430 may interact with an interface console 1438 which may include GUIs, displays, and other devices that interact with an operator. A network interface 1460 couples the interface console 1438 to a network 1490, which may comprise, for example, the Internet, a local area network (LAN), or a wide area network (WAN).

Similarly, a remote user 1520 at a second location 1502 interacts with a system 1508 which operates a heavy bag 24. The heavy bag 24 is suspended from a support carriage 1556. The support carriage 1556 is driven by a motor module 1580. A transducer bank 1570 exchanges information with the heavy bag 24. The motor module 1580 and the transducer bank 1570 interact with a local control unit 1530. The local control unit 1530 may interact with an interface console 1538 which may include GUIs, displays, and other devices that interact with an operator. A network interface 1560 couples the interface console 1538 to the network 1490. The network 1490 may comprise, for example, the Internet, a local area network (LAN), or a wide area network (WAN).

Each of the embodiments above may include a video camera and processing circuitry for controlling movement of the heavy bag 24 in response to motion of any user. Many programs can provide different functions such as monitoring movement of the user 20, predicting movement, responding to movement, creating or responding to sound, or sensing speed of reactions of the user 20. Sensors may also be placed in gloves of the user 20 to interact with the system.

Figure 16:
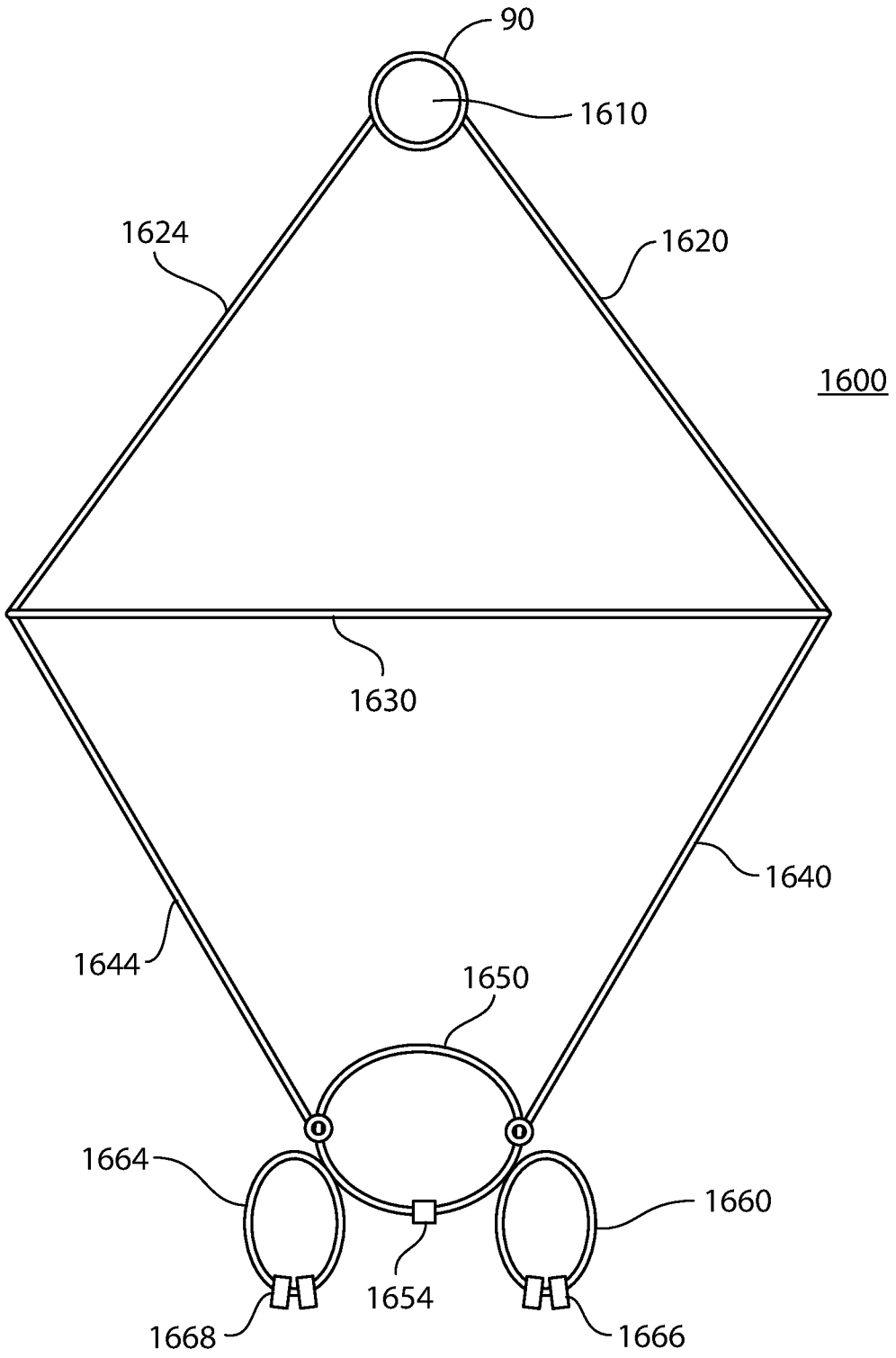
FIG. 16 illustrates a rehabilitation embodiment in which a harness assembly is provided to support a user who requires assistance in being able to stand for training.

FIG. 16 illustrates a rehabilitation embodiment in which a harness assembly 1600 is provided to support a user 20 who requires assistance in being able to stand for training. A ring 1610 is supported to the support carriage 90. A first upper support cable 1620 and a second upper support cable 1624 each have an upper end secured to the ring 1610. Lower ends of the first upper support cable 1610 and the second upper support cable 1624 are connected to opposite lateral ends of a spacer bar 1630. A first lower support cable 1640 and a second lower support cable 1644 have upper ends secured to opposite lateral ends of the spacer bar 1630. Lower ends of the first lower support cable 1640 and the second lower support cable 1644 are secured to angularly displaced points on a midsection harness 1650. The midsection harness 1650 is positioned to surround the user 20 and is closed by a clasp 1654. A first leg harness 1660 and a second leg harness 1664 are secured to the midsection harness 1650 for supporting first and second legs of the user 20. The first leg harness 1660 is closed by a clasp 1666. The second leg harness 1664 is closed by a clasp 1668. In one embodiment, each one of the support cables 1620, 1624, 1640, and 1644 is 40 inches long and the spacer bar 1630 is 45 inches long. This proportion provides for stable support for the user 20.

While the invention has been described in terms of several embodiments, those of ordinary skill in the art will recognize that the invention is not limited to the embodiments described, but can be practiced with modification and alteration within the spirit and scope of the teachings herein. The description is thus to be regarded as illustrative rather than limiting.

The invention claimed is:

1. An interactive training apparatus for moving a supported heavy bag in multiple linear degrees of freedom creating an interactive experience for a user comprising:

a. a Cartesian gantry, said Cartesian gantry having a support carriage releasably secured to the heavy bag, said support carriage being movable to commanded positions with respect to orthogonal axes;

b. drive motors in said Cartesian gantry coupled for receiving control signals indicative of commanded movements to go from a current position to a next position irrespective of the current position, said drive motors being mechanically coupled to move said support carriage with respect to each of the orthogonal axes;

c. a local control unit providing sequential motion commands to said drive motors;

d. a first processor responsive to inputs and configured to provide data to said local control unit for translation into motion commands;

e. a command source providing the data to said local control unit, said command source comprising a program memory;

f. a second processor and transducers, both located in said heavy bag and providing signals indicative of interaction between said heavy bag and the user, a sensor module, said sensor module receiving the signals indicative of interaction;

g. said local control unit further comprising said first processor configured to receive signals from said sensor module for comparison to a preselected set of instructions and processing said signals to modify movement commands in response to the comparison; and h. said first processor being configured to receive input signals and to produce an indication of a user's performance based only on data generated at the heavy bag in comparison to stored criteria.

2. The interactive training apparatus according to claim 1 further comprising the heavy bag, the heavy bag further comprising a transducer bank responsive to actions of the user striking the heavy bag.

3. The interactive training apparatus according to claim 1 further comprising a transducer bank located in the heavy bag and wherein data from said transducer bank is coupled to the local control unit to provide data for comparison to criteria indicative of performance data of the user and wherein said heavy bag comprises an indicator bank receiving input information from said local control unit.

4. The interactive training apparatus according to claim 3 wherein the inputs for generating the performance data consist of data indicating locations of blows, timing of blows, and intensity of blows.

5. The interactive training apparatus according to claim 4 wherein said first processor is configured to provide inputs to said indicator bank to translate programmed actions to indications on said heavy bag.

6. The interactive training apparatus according to claim 5 wherein said first processor is configured to compare information from the transducer bank to a preselected set of instructions and in response to the preselected set of instructions and modifying direction of movement commands to the Cartesian gantry.

7. The interactive training apparatus according to claim 6 wherein said first processor is configured to modify the degree of movement commanded by an individual command signal in response to the comparison.

8. The interactive training apparatus according to claim 7 further comprising a trainer console interactively coupled with said local control unit for enabling production of real-time commands by a trainer.

9. The interactive training apparatus according to claim 8 further comprising network interconnections to a network wherein said local control unit is coupled for interaction with remote locations and further comprising a graphical user interface coupled to the network to allow the user to remotely monitor and control the heavy bag.

10. A method for moving a supported heavy bag in multiple linear degrees of freedom to create an interactive experience for a user comprising:

a. providing a heavy bag and a Cartesian gantry for moving the heavy bag in multiple orthogonal X-Y linear degrees of freedom;

b. providing transducers and a second processor located in the heavy bag for providing signals to a first processor in a local control unit;

c. providing drive motors in said Cartesian gantry being responsive to commands from the local control unit for moving the heavy bag and moving the heavy bag from a current position to a next position;

d. producing in the local control unit sequential signals to command movements of the drive motors;

e. coupling input signals to the first processor from a program memory, the input signals being indicative of a preselected training exercise;

f. coupling the sequential signals from the first processor to the drive motors;

g. providing from a second processor outputs in response to transducer outputs from transducers in response to blows of the user delivered to the heavy bag;

h. coupling outputs of said second processor to said first processor; and i. comparing signals received at the local control unit to values stored which are indicative of the preselected training exercise for establishing user performance data and modifying commanded movements in response to the comparing of signals.

11. The method according to claim 10 wherein providing commands from the first processor in response to a decision tree, each branch decision being made in response to the transducer outputs, the decision tree comprising an instruction to select a next branch at which a next branch decision is made and wherein the decision tree includes branches that lead to an endpoint.

12. The method according to claim 10 wherein providing commands from the first processor further comprises producing commands in response to real-time inputs of a trainer.

13. The method according to claim 10 wherein the step of providing input indicative of commanded motions comprises producing commands for movement of the heavy bag to present to the user varying positions to simulate an opponent to which the user must quickly respond.

14. The method according to claim 13 wherein the heavy bag responds with a set of commands corresponding to the known moves of a selected particular fighter.

15. The method according to claim 14 further comprising providing an instruction for interfacing the local control unit to a graphical user interface and to a network to allow the user to remotely monitor and control the heavy bag, and at the graphical user interface consolidating the analytics output of said second processor into a human readable format.

* * * * *